US005377959A

United States Patent [19]

Besch et al.

[11] Patent Number: 5,377,959

[45] Date of Patent: Jan. 3, 1995

[54] APPARATUS FOR IMPROVING SERVICE LIFE OF THERMITE RAIL WELDS

[75] Inventors: Gordon O. Besch, New Brighton, Minn.; Robert H. Kachik, Lakehurst; Swartz: Mark A., Brick, both of N.J.; Frank K. Kuster, Ratingen; Hans J. Guntermann, Essen, both of Germany

[73] Assignee: Orgo-Thermut Inc., Lakehurst, N.J.

[21] Appl. No.: 121,829

[22] Filed: Sep. 15, 1993

Related U.S. Application Data

[62] Division of Ser. No. 955,947, Oct. 2, 1992, Pat. No. 5,306,361.

[51] Int. Cl.[6] ..... C21B 15/00

[52] U.S. Cl. ..... 266/167; 266/274; 266/280; 266/286; 164/54; 432/225

[58] Field of Search ..... 266/274, 280, 286, 287, 266/167; 432/253, 254.1, 258; 148/529, 581; 164/54, 333, 355, 53, 394, 395, 396, 520, DIG. 12, 76.1, 270.1

[56] References Cited

U.S. PATENT DOCUMENTS

| | | | |
|---|---|---|---|
| 1,793,047 | 2/1931 | Brewitt | 164/54 |
| 3,113,359 | 12/1963 | Burke | 164/54 |
| 3,620,291 | 11/1971 | Aillant-sur-Tholon | 164/54 |
| 4,830,611 | 5/1989 | Guntermann et al. | 432/225 |

*Primary Examiner*—Richard O. Dean
*Assistant Examiner*—Sikyin Ip
*Attorney, Agent, or Firm*—Anderson Kill Olick & Oshinsky

[57] ABSTRACT

In the heat treatment in the field of a thermite weld between rail ends, the rail ends and the weld are enclosed within a containment filled with an aluminothermic material mixture. The mixture is ignited and the rail ends and the thermite weld are heat-treated for a given period. After the given period, the aluminothermic reaction products and the containment are removed, and an air quench unit is placed about the weld and rail ends and compressed air is directed at the weld and rail ends for a given time period. After the removal of the air quench unit, the weld is allowed to cool to ambient temperature.

6 Claims, 3 Drawing Sheets

APPARATUS FOR IMPROVING SERVICE LIFE OF THERMITE RAIL WELDS

This is a division of application Ser. No. 07/955,947, filed Oct. 2, 1992, U.S. Pat. No. 5,306,361.

BACKGROUND OF THE INVENTION

The present invention is directed to improving the service life of thermite welds for rails, and involves a special heat treatment of the existing thermite welds for improving their mechanical properties and thereby increasing their service life.

Thermite welding of rails is used throughout the world to join lengths of rails into continuous track work. There are other methods of welding rails, however, the thermite process has experienced wide utilization, due to its relative simplicity, portability of the equipment used, and its low cost. Throughout this century, thermite welds have afforded satisfactory service performance, relative to the service life of other types of welds and of the rail. The advent of increased axle loads in some localities and/or programs intended to extend the life of the rails have placed increased demand on thermite rail welds, which warrants programs aimed at improving the service life of the welds.

Since thermite welds are essentially steel castings, it has been proposed that the mechanical properties of the weld and, consequently, their service life, should be improved by a post-weld heat treatment. In heat treating experiments using samples sectioned from thermite welds, it has been found that the mechanical properties of the welds can be significantly improved by heating the weld into the austenite range and then air cooling, which is a conventional heat treatment known as normalizing. In normalizing, the main benefit is a refinement of the grain size. The weld metal in the rail head, however, may become softened during normalizing and this is undesirable for wear resistance. Further, it is known that thermite weld metal can be heat-treated without softening by heating it into the austenite range and then utilizing enhanced cooling to force the transformation from austenite to pearlite to occur at a lower temperature.

Therefore, it is known that samples sectioned from aluminothermic welds can be heat-treated under controlled conditions for producing weld metal with improved mechanical properties and required hardness by utilizing well-known metallurgical principles. The transfer of the known metallurgical principles from weld samples to the actual treatment of full size welds in existing track work is difficult to achieve and, at the present time, there are no known effective methods.

SUMMARY OF THE INVENTION

Therefore, the primary object of the present invention is to improve the mechanical properties of new thermite welds so that their service life is significantly extended.

Another object of the present invention is to utilize the same method and apparatus on all types of existing rail welds to improve their service life.

In view of the often remote locations at which rail welds are made, it is important that the heat treatment of the existing thermite welds can be carried out in a simple, effective and relatively inexpensive manner.

In accordance with the present invention, an existing thermite weld is fitted or enclosed within a relatively simple reusable containment or container-like form arranged to hold a predetermined amount of a specially formulated aluminothermic material mixture. The containment is shaped to enclose the entire weld, the adjoining rail ends and the aluminothermic mixture to be used for heat treating the weld joint. The aluminothermic mixture within the container and enclosing the weld joint is ignited by known means. At a predetermined time after ignition, the container and the aluminothermic reaction products are removed. When the temperature of the heat-treated weld is still in the austenite range, the weld may be quenched with air by well-known means to harden the rail head to a specified hardness. After completing the air quenching step the weld joint is allowed to cool to ambient temperature.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DETAILED DESCRIPTION OF THE INVENTION

Figure 1:
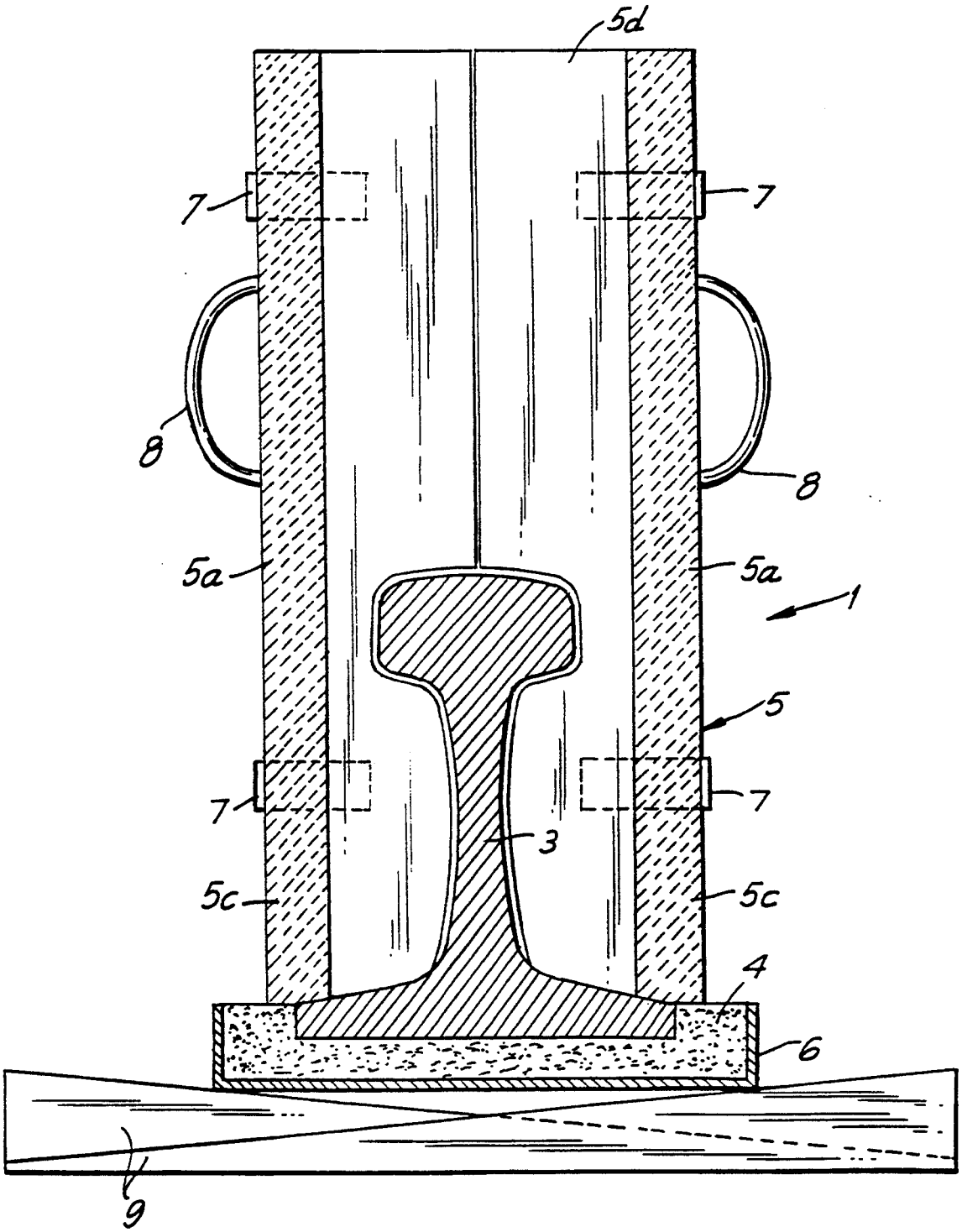
FIG. 1 is a cross-sectional view of a containment of the present invention enclosing the thermite weld joint to be heat-treated.

The apparatus for heat treating a thermite weld includes a containment or form-like member 1 surrounding the entire weld 2 and a part of the adjoining rail ends 3 with a predetermined amount of a specially formulated aluminothermic heating compound 4. The form-like member 1 is made up of two containers 5, 6, a top container 5 constructed of graphite plates for enclosing the major part of the weld 2 and a steel base pan 6 for enclosing the sides and bottom of the weld flange and the adjacent flanges of the rail ends 3.

The graphite top container 5 is fabricated from one-inch thick planar surfaces graphite plates in the form of two halves **5*a*, which fit against the opposite sides of the rail. Each half consists of a side plate 5*c* and two end plate 5*d*. Note in FIGS. 1, 2 and 3 the side plates 5*c* and the end plates 5*d* are planar surfaced with the plates presenting flat or planar vertically extending surfaces facing toward the weld 2 between the rail ends 3. It can be seen best in the cross-sectional elevational view in FIG. 1 and in the top view of FIG. 3 that the inwardly facing surfaces of the side plates 5*c* and the end plates 5*d* are flat or planar, as indicated by the one-inch thick dimensions of the plates forming the two halves 5*a*. The side plates and end plates are connected by angle irons 7, attached with screws, not shown. Alternatively, the plates can be connected only with screws. The end plates 5*d* extending transversely of the planar surfaces are shaped to fit the contour of the rail; that is, the upper surface of the rail flange, the rail web and the rail head, leaving a small gap along the web and head of the rail to accommodate slight variations in the rail dimensions, as shown in FIG. 1. Both the end plates and the side plates extend above the rail head, where the end plates from the two halves meet to form snug joints. As shown in FIG. 3, the end plates are attached at the ends of the side plates. The two halves 5a of the top container are then placed against opposite sides of the rail and held in place by two large "C" clamps, not shown, located at opposite ends of the two halves. Handles 8 are located on each outer side of the top container 5** for ease in installing the container halves and removing them while they are hot.

Figure 2:
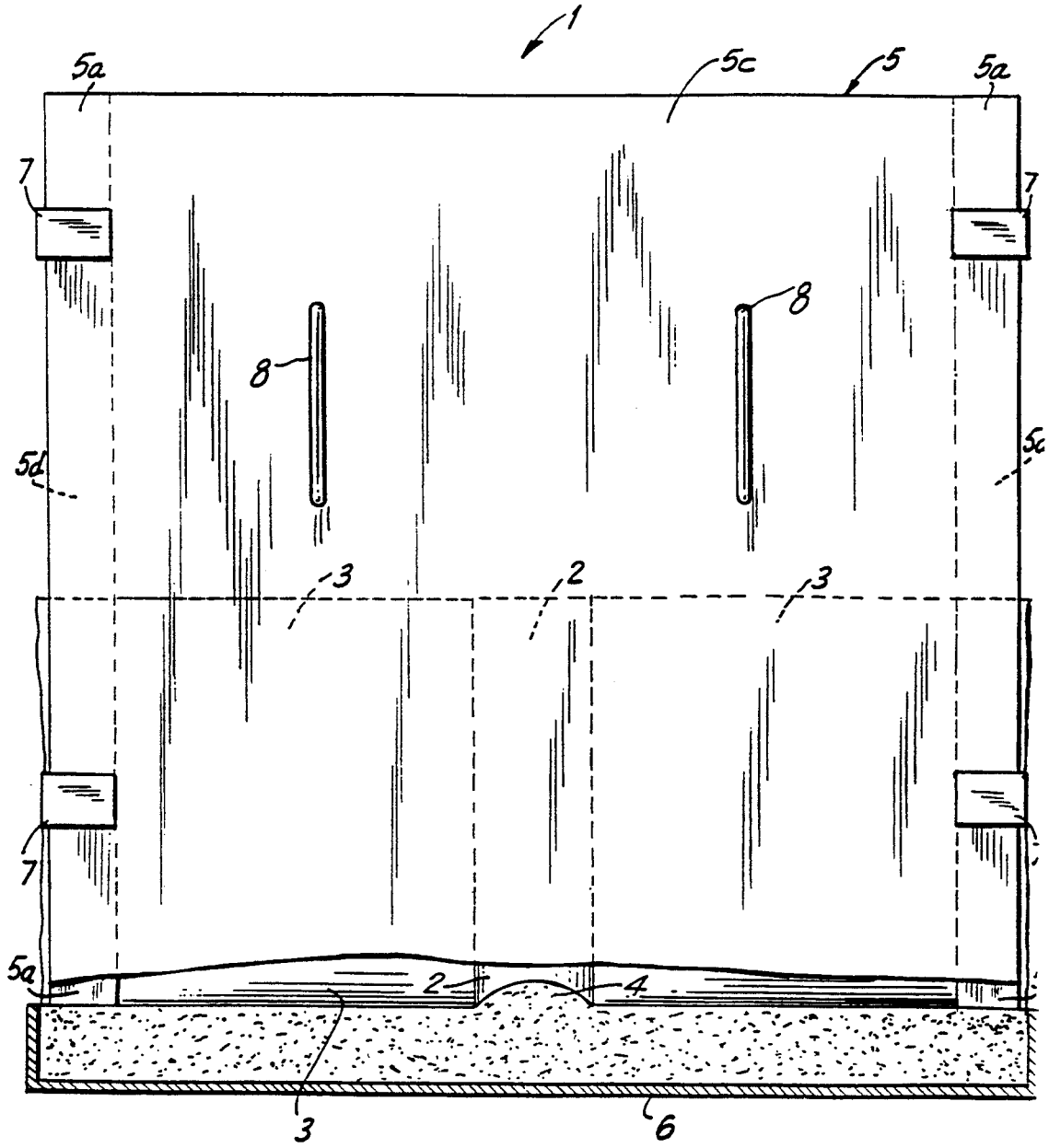
FIG. 2 is a side view of the containment shown in FIG. 1 partly in section.
Figure 3:
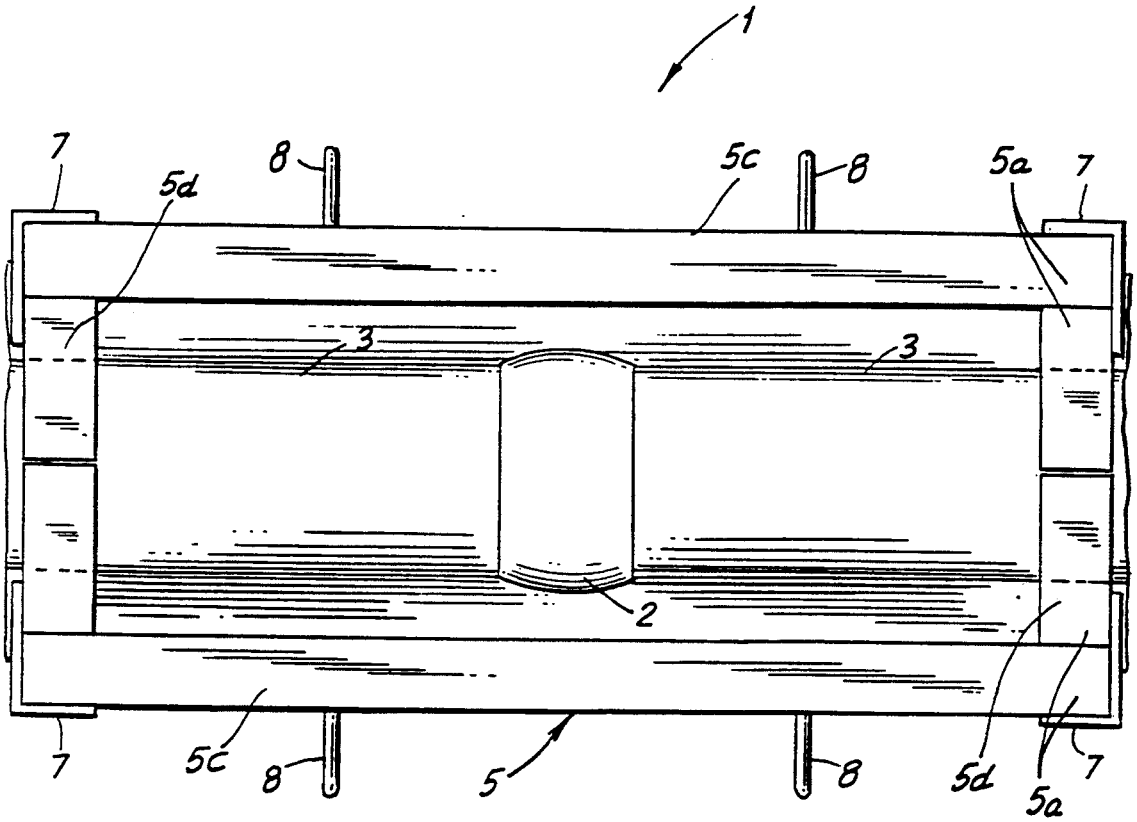
FIG. 3 is a top view of the containment shown in FIG. 1.

The top container 5 rests on the top of the rail flange and the bottom edges of side plates 5c of the two halves are notched at mid length to fit over the collar of the weld previously formed, note FIG. 2. As shown in FIG. 3, the thermite weld 2 has a larger cross-sectional dimension than the rail due to the presence of a normal weld collar. The weld is positioned at the mid length and the mid width of the graphite container. As a result, the end plates 5d contact only the rail ends and are equally spaced from the weld 2.

After the container halves 5a have been installed around the weld and the rail ends and clamped in place, any gaps between the box they form and the rail are sealed with luting sand, sealing paste or any other well-known sealant to prevent leakage when the aluminothermic compound is placed within the container 5. The steel base pan 6, filled with aluminothermic compound, is then centered under the weld 2 and the rail ends 3 and is forced upwardly against the underside of the weld and the rail ends by suitable wedges 9. The base pan 6 is installed only after the top container 5 has been sealed to avoid any luting material from falling into the aluminothermic compound in the base pan.

The aluminothermic compound is then introduced into the top container 5. A composition of the compound is 34% aluminum powder, 37% iron oxide (17 FeO) and 29% silica sand. The amount of the compound required to heat treat a weld is established by experiment for determining the requisite amount to heat the entire weld and the adjoining rail end to the austenitizing temperature (850°–950° C.) based on experiments with 132# rail. Accordingly, 3 Kg of the compound is placed in the base pan 6 and 13 Kg is introduced into the top container 5. For different rail sizes, the amount of compound placed in the container 5 is varied in direct proportion to the change in the rail size, however, the amount used in the base pan remains the same.

Standard thermite igniters are placed in two opposite corners of both the container 5 and the base pan 6; that is, four igniters are used, and they are ignited essentially simultaneously. After approximately two minutes, all of the aluminothermic compound within the container 1 has reacted. After an additional eight-minute delay allowing the heat from the aluminothermic reaction products to be transferred to the weld and the adjoining rail ends, the container 5, the base pan 6 and the reaction products are removed. The parts making up the top container 5 and the base pan 6 are reusable for an indefinite number of times.

Immediately after removal of the form-like container 1 and the aluminothermic reaction products, the entire weld and adjoining rail ends are at the temperature of austenite. If simply allowed to air cool to ambient temperature, the process is known as normalizing and the properties of the weld metal would be improved because of grain refinement. The weld metal in the rail head, however, may not be hard enough to provide the wear resistance needed in most applications. Accordingly, the head of the weld and the head of the adjoining rail ends can be hardened to that of standard rails (about 285–330 BHN-Brinell Hardness Number) or premium rails (about 330–390 BHN) by a suitable air quench supplied before the rail head has cooled to about 650 ° C. This hardening method is well-known and utilizes commercially available devices for directing air onto the treated rail head, and controlling and measuring the air flow to obtain a specified hardness. Portable equipment for providing a sufficient volume and pressure of compressed air is available commercially.

The method described above has been used to heat treat a substantial number of thermite welds out-of-track for various metallurgical and mechanical property tests, including grain-size measurements, hardness traverses, tensile tests, slow-bend tests, fatigue tests, drop tests and residual-stress measurements. In all cases it has been found that the metallurgical characteristics and mechanical properties of the treated welds were significantly improved over untreated welds, and the desired hardness of the rail head was achieved with a proper air quench.

In further studies with heat-treated welds, samples of both untreated and heat-treated welds were sectioned longitudinally and then polished and etched to reveal the macrostructure of the weld metal, the heat-affected zones (HAZs- the rail ends that had been heated into the austenite range and then transformed to pearlite during cooling) and the HAZ boundaries, the regions between the HAZs and the unaffected rail ends where the original pearlite was spheroidized by heating to just below the austenite temperature. HAZ boundaries are markedly softer than normal pearlite and their occurrence is unavoidable in welds. In untreated welds, the HAZs on each side of the welds are about ½ of an inch long, while the HAZ boundaries are about ¼ of an inch long.

The studies of heat-treated welds show that all original HAZs and HAZ boundaries have been obliterated by the heat treatment and that the new HAZs are about 2¼ inches long. The new HAZ boundaries are again about ¼ inch long. Thus, the soft HAZ boundaries have been moved about 1¾ inches away from the weld. It is believed that this displacement of the HAZ boundary will have a beneficial influence on the service life of the weld.

In summary, all tests of thermite welds that were heat-treated out-of-track have shown that the treatment improves the mechanical properties of the weld. Currently, thermite welds that have been heat-treated in-track are undergoing actual field service tests on revenue service railroads and on an accelerated service test facility.

While elements of the heat-treating methods are known in general heat-treating operations, it has not been known to heat-treat actual thermite welds in the field.

Although it is preferred that the composition of the aluminothermic heating compound is 34% aluminum powder, 37% iron oxide (17 FeO) and 29% silica sand, good success has been achieved with a mixture of 27% aluminum powder, 50% iron oxide (17 FeO) and 23% silica sand. Accordingly, any composition in the range of 25 to 40% aluminum powder, 35 to 55% iron oxide (17 FeO) and 15 to 35% silica sand should be satisfactory.

While specific embodiments of the invention have been shown and described in detail to illustrate the inventive principles, it will be understood that the invention may be embodied otherwise without departing from such principles.

We claim:

1. Apparatus for heat treating a thermite weld between adjacent rail ends where the rail ends and the weld have a bottom flange, a web extending upwardly from the bottom flange, and a head at an upper end of the web, comprising means for enclosing the rail ends and thermite weld and forming a space for holding an aluminothermic material mixture in contact with and enclosing the rail ends and the weld, said means comprise a bottom pan side walls and end walls, said bottom pan is formed of steel and is aligned with and spaced below the bottom flanges of the rail ends and the thermite weld, said pan having upwardly extending edges located laterally outwardly from opposite sides of the flanges, said bottom pan arranged to contain a given amount of aluminothermic mixture, said side walls located on opposite sides of and spaced outwardly from the rail ends and web and bearing on and extending upwardly from an upper side of the bottom flanges to above the rail head, said side walls located inwardly from said edges of said bottom pan, end walls extending transversely of and inwardly from said container walls into contact with the rail ends and extending upwardly above the rail head, said side walls and end walls are formed of graphite plates and form a laterally closed space for the aluminothermic mixture about the rail ends and thermite weld.

2. Apparatus, as set forth in claim 1, wherein said side walls and end walls are formed of planar surfaced graphite plates having a thickness of approximately 1".

3. Apparatus, as set forth in claim 1, including means for connecting said side walls and end walls together.

4. Apparatus, as set forth in claim 3, wherein said means comprising angle irons for connecting said side walls and end walls together.

5. Apparatus, as set forth in claim 3, wherein handles connected to outer sides of said side walls for ease in installing said side and end walls.

6. Apparatus, as set forth in claim 5, wherein wedges located below said bottom pan against the bottom flange of the rail ends and weld.

* * * * *